US011021415B2

(12) United States Patent
Muller

(10) Patent No.: US 11,021,415 B2
(45) Date of Patent: Jun. 1, 2021

(54) CONDUCTIVE SHOCK TUBE

(71) Applicant: DETNET SOUTH AFRICA (PTY) LTD, Sandton (ZA)

(72) Inventor: Elmar Lennox Muller, Sandton (ZA)

(73) Assignee: DETNET SOUTH AFRICA (PTY) LTD, Sandton (ZA)

( * ) Notice: Subject to any disclaimer, the term of this patent is extended or adjusted under 35 U.S.C. 154(b) by 111 days.

(21) Appl. No.: 16/065,153

(22) PCT Filed: Sep. 28, 2017

(86) PCT No.: PCT/ZA2017/050073

§ 371 (c)(1),
(2) Date: Jun. 22, 2018

(87) PCT Pub. No.: WO2018/068067

PCT Pub. Date: Apr. 12, 2018

(65) Prior Publication Data

US 2020/0271430 A1 Aug. 27, 2020

(30) Foreign Application Priority Data

Oct. 7, 2016 (ZA) ..... 2016/06882

(51) Int. Cl.

| | |
|---|---|
| ***C06C 5/06*** | (2006.01) |
| ***F42D 1/04*** | (2006.01) |
| ***C06C 5/04*** | (2006.01) |

(52) U.S. Cl.
CPC ..... *C06C 5/06* (2013.01); *C06C 5/04* (2013.01); *F42D 1/043* (2013.01)

(58) Field of Classification Search
CPC ..... C06C 5/06; C06C 5/04; F42D 1/043
See application file for complete search history.

(56) References Cited

U.S. PATENT DOCUMENTS

| | | | | | |
|---|---|---|---|---|---|
| 1,631,756 | A * | 6/1927 | Olin | F42B 39/30 | 102/202.12 |
| 4,024,817 | A * | 5/1977 | Calder, Jr. | C06C 5/04 | 102/275.8 |
| 4,403,143 | A * | 9/1983 | Walker | C06C 5/04 | 102/275.8 |
| 4,777,878 | A * | 10/1988 | Johnson | E21B 43/1185 | 102/202.5 |
| 4,886,126 | A * | 12/1989 | Yates, Jr. | E21B 43/11852 | 175/4.54 |
| 5,010,821 | A * | 4/1991 | Blain | C06C 5/04 | 102/275.5 |

(Continued)

FOREIGN PATENT DOCUMENTS

| | | |
|---|---|---|
| WO | 94/15169 A1 | 7/1994 |
| WO | 2013/044275 A1 | 3/2013 |

OTHER PUBLICATIONS

International Search Report and Written Opinion for Application No. PCT/ZA2017/050073 dated Mar. 14, 2018 (8 pages).

*Primary Examiner* — Michelle Clement
(74) *Attorney, Agent, or Firm* — Michael Best & Friedrich LLP

(57) ABSTRACT

A shock tube for propagating and initiating a signal to an explosive charge which includes at least first and second elongate flexible conductors on a body of the detonator to enable two-way communication between the explosive charge and a blasting machine thereby to confirm the status of the detonator prior to sending a fire signal.

9 Claims, 1 Drawing Sheet

(56) References Cited

U.S. PATENT DOCUMENTS 5,070,789 A 12/1991 True et al.
5,191,936 A * 3/1993 Edwards ..... E21B 43/11855 166/297
5,436,791 A * 7/1995 Turano ..... E21B 43/1185 102/218
5,505,134 A * 4/1996 Brooks ..... E21B 43/1185 102/202.7
5,551,520 A * 9/1996 Bethel ..... E21B 43/1185 175/4.54
6,179,064 B1 * 1/2001 Vaynshteyn ..... F42D 1/055 175/4.54
6,523,449 B2 * 2/2003 Fayard ..... E21B 43/117 102/310
6,598,682 B2 * 7/2003 Johnson ..... E21B 37/08 166/370
6,604,584 B2 * 8/2003 Lerche ..... E21B 41/00 102/215
6,719,061 B2 * 4/2004 Muller ..... E21B 33/068 166/373
6,752,083 B1 * 6/2004 Lerche ..... E21B 43/1185 102/202.5
6,837,310 B2 * 1/2005 Martin ..... E21B 43/117 166/297
7,007,756 B2 * 3/2006 Lerche ..... E21B 17/003 166/297
7,146,912 B2 * 12/2006 Bokvist ..... F42C 11/06 102/215
7,172,023 B2 * 2/2007 Barker ..... E21B 43/117 166/297
7,303,017 B2 * 12/2007 Barker ..... E21B 43/119 166/297
7,980,309 B2 * 7/2011 Crawford ..... E21B 43/1185 166/297
9,065,201 B2 * 6/2015 Borgfeld ..... H01R 13/5833
9,611,726 B2 * 4/2017 Sangare ..... E21B 43/1195
10,386,168 B1 * 8/2019 Preiss ..... F42B 1/02
2004/0003743 A1 * 1/2004 Brooks ..... F42B 3/12 102/202.7
2006/0196665 A1 * 9/2006 LaGrange ..... E21B 43/11852 166/298

* cited by examiner

CONDUCTIVE SHOCK TUBE

BACKGROUND OF THE INVENTION

This invention relates to a conductive shock tube.

A conventional shock tube is capable of enabling communication in one direction only i.e. a fire signal that is transmitted from a blasting machine, via the shock tube, to an explosive charge. Communication from a detonator to the blasting machine is not possible. Thus, the status of the detonator prior to sending the fire signal cannot be confirmed, prior to detonation, using the shock tube. Additionally a shock tube cannot convey information, other than the fire signal, to a detonator.

An aim of the current invention is to address, at least partially, the aforementioned situation.

SUMMARY OF INVENTION

The invention provides a shock tube for propagating an initiating signal to an explosive charge, the shock tube including a body that is connectable to a blasting machine and at least first and second elongate flexible conductors on or in the body which enable two-way communication between the explosive charge and the blasting machine.

Each conductor may be in the form of a coating or a deposit made from a stretchable electrically conducting material. The material may be an organic/polymeric conductive material, a metal oxide-based material, or may be made from a mixture of an organic/polymeric conductive material and a metal oxide-based material.

Each conductor may be printed using a suitable technique on or in the body. Each conductor may be printed in a pattern which is suitable to flexing or stretching deformation of the shock tube, without breaking the conductor.

Each conductor may be printed on a respective layer of material that surrounds an energy propagating core of the shock tube. Preferably, a first conductor is printed on a first layer of material that surrounds the energy propagating core and a second conductor is printed on a second layer of material which surrounds the first layer of material.

The first and the second conductors may culminate in a suitable connecting member which is connectable to a connector located in or on a detonator.

The invention also provides a connector for connecting a shock tube of the aforementioned kind to the explosive charge which, preferably, is a detonator.

BRIEF DESCRIPTION OF THE DRAWINGS

The invention is further described by way of example with reference to the accompanying drawings wherein.

DESCRIPTION OF PREFERRED EMBODIMENT

Figure 1:
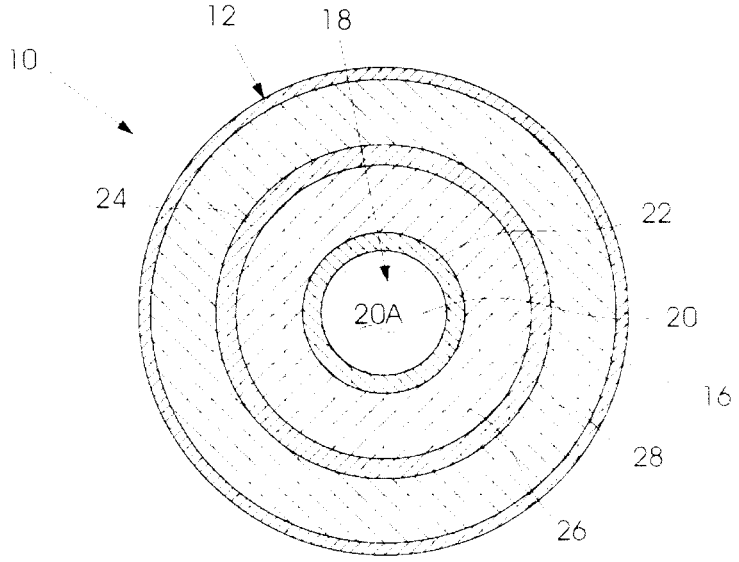
FIG. 1 is a cross-sectional view of a conductive shock tube according to the invention.

FIG. 1 of the accompanying drawings illustrates a shock tube 10 which includes an elongate tubular body 12 which defines a bore 18 housing a core 20 made from or containing an energy propagating material 20A.

The energy propagating material 20A is surrounded by a first protective layer 22 and a second protective layer 24.

Each layer 22, 24 consists of a suitable material having appropriate electrical insulating, waterproof and abrasion-resistant properties.

A first elongate flexible conductor 26 and a second elongate flexible conductor 28, each in the form of a conductive coating, are printed on the first and the second layers respectively. Each of the conductors 26 and 28 completely surrounds the respective layer 22, 24. This is by way of example only and is non-limiting.

Figure 2:
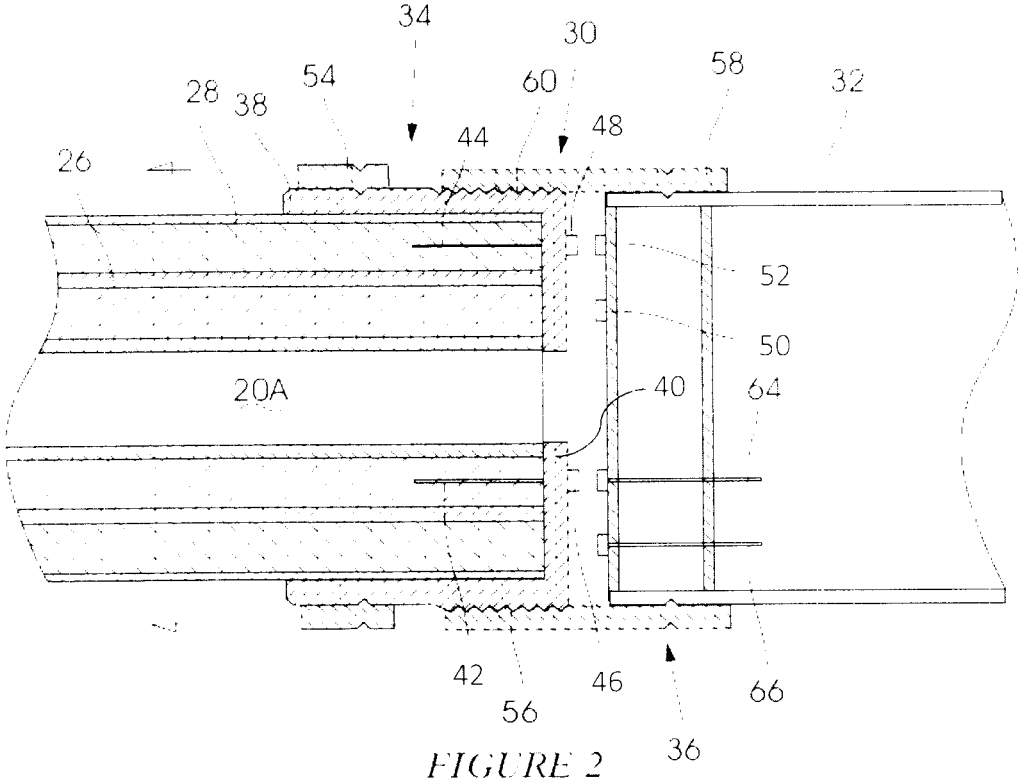
FIG. 2 is a schematic representation of a connecting member for connecting first and second conductors of the shock tube of FIG. 1 to a detonator.

The first and second conductors 26 and 28, at an end 30 of the shock tube which, in use, is to be connected to a detonator 32, culminate in a connecting member 34 which is connectable to a connector 36 of the detonator—see FIG. 2. The connecting member 34 includes a cap 38 which is fitted onto the end 30, a support structure 40, and contacts in the form of a first conductive pin 42 and a second conductive pin 44 which extend to one side of the support structure (to the left in FIG. 2). Each pin 42, 44 is embedded in or penetrates the first conductor 26 and second conductor 28 respectively.

A first contact or conductive nub 46 and a second contact or conductive nub 48 are connected to the first and second pins 42 and 44 respectively which extend through the support structure 40. The connector 36, on the detonator, has annular conductive surfaces 50 and 52 which respectively oppose the conductive nubs 46 and 48.

The cap 38 is attached to the end 30 in any suitable way e.g. by means of a crimping member 54. The cap 38 includes an external thread 56.

The connector 36 includes a formation 58 which is complementary to the cap 38 and has an internal thread 60 which is threadedly engageable with the thread 56. In use, the formation 58 and the cap 38 are threadedly secured to each other to hold the nubs 46, 48 and the surfaces 50 and 52 respectively in electrical contact with one another.

Electrical leads 64 and 66 extend from the surfaces 50 and 52 to electronic components (not shown), in the detonator 32.

As an alternative to the tubular conductors 26 and 28, the first and second conductors may each be printed in a wavy or spiral pattern on respective tubular substrates or layers e.g. the layers 22, 24. These patterns allow for flexing and stretching of the shock tube, without leading to breaking of the conductors.

The first and second layers 22, 24 could each be coated with the material which forms the first and second conductors, using techniques that do not require alteration of existing shock tube manufacturing techniques.

The conductors 26 and 28 are made from an organic/polymeric conductive material, or a metal oxide-based material, or a mixture of the organic/polymeric conductive material and a metal oxide-based material. This type of material can be "stretched" to a substantial degree without breaking.

In the drawings the conductors 26, 28 are shown enlarged. This is for illustrative purposes only. In practice the conductors are thin, particularly if formed by means of a printing technique, and the shock tube 10 would have a diametrical dimension substantially equal to that of a conventional shock tube.

The invention claimed is:

1. A shock tube for propagating an initiating signal from a blasting machine to an explosive charge, the shock tube comprising:

a core of an energy propagating material, a first protective layer which surrounds the core, a second protective layer which surrounds the first protective layer, a first elongate flexible conductor between the first protective layer and the second protective layer, and a second elongate flexible conductor on an outer side of the second protective layer, wherein the first and second elongate flexible conductors enable two-way communication between the explosive charge and the blasting machine.

2. The shock tube according to claim 1, wherein each of the first and second elongate flexible conductors is made from a stretchable electrically conducting material.

3. The shock tube according to claim 2, wherein the stretchable electrically conducting material is selected from an organic/polymeric conductive material, a metal oxide-based material or a mixture of an organic/polymeric conductive material and a metal oxide-based material.

4. The shock tube according to claim 1, further comprising a cap attached to an end of the core and two contacts on the cap which are respectively electrically connected to the first and second elongate flexible conductors.

5. The shock tube according to claim 1, wherein the first elongate flexible conductor is tubular, and the second elongate flexible conductor is tubular.

6. The shock tube according to claim 1, wherein the first elongate flexible conductor is in a wavy or spiral pattern, and the second elongate flexible conductor is in a wavy or spiral pattern.

7. The shock tube according to claim 1, wherein the shock tube has a diametrical dimension equal to that of a conventional shock tube.

8. The shock tube according to claim 1, wherein at least one of the first and second elongate flexible conductors is provided as a coating or deposit.

9. The shock tube according to claim 1, wherein each of the first and second elongate flexible conductors is provided as a coating or deposit.

* * * * *